United States Patent [19]

Gould et al.

[11] Patent Number: 4,938,472

[45] Date of Patent: Jul. 3, 1990

[54] GAME WITH STACKING PIECES ON INCLINED SURFACES

[76] Inventors: Murray J. Gould, 11712 Silent Valley La., Gaithersburg, Md. 20878; James R. Longacre, 3621 Littledale Rd., Kensington, Md. 20895

[21] Appl. No.: 299,432

[22] Filed: Jan. 23, 1989

[51] Int. Cl.[5] ..... A63F 7/38

[52] U.S. Cl. ..... 273/241; 273/157 R; 273/282; 434/96

[58] Field of Search ..... 273/241, 276, 282, 287, 273/290, 293, 294, 309, 153 P, 157 R; 434/208, 96, 403, 406

[56] References Cited

U.S. PATENT DOCUMENTS

| | | | |
|---|---|---|---|
| 1,087,207 | 2/1914 | Austin | 273/157 R |
| 1,709,660 | 4/1929 | De Bracht | 273/157 R |
| 2,506,189 | 5/1950 | Attridge | 273/157 R |
| 3,151,867 | 10/1964 | Miller | 273/282 R |
| 3,420,527 | 1/1969 | Morin | 434/96 X |
| 3,433,485 | 3/1969 | Renn et al. | 273/157 R |
| 3,608,906 | 9/1971 | Odler | 273/294 X |
| 3,618,955 | 11/1971 | Barnes | 273/157 R |
| 3,695,615 | 10/1972 | Shoptaugh | 273/282 R X |
| 4,133,538 | 1/1979 | Ambrose | 273/157 R X |
| 4,254,957 | 3/1981 | Kramer | 273/282 R X |
| 4,257,609 | 3/1981 | Squibbs | 273/241 |
| 4,573,688 | 3/1986 | Grimes | 273/241 |
| 4,662,846 | 5/1987 | Quercetti | 434/96 |

*Primary Examiner*—Edward M. Coven
*Assistant Examiner*—William E. Stoll

[57] ABSTRACT

A stacking game in which square shaped markers are placed on an inclined surface and supported directly or indirectly by raised portions forming notches extending along the lower edge of the surface. A plurality of such surfaces can be joined together in a pyramid or other configuration.

15 Claims, 2 Drawing Sheets

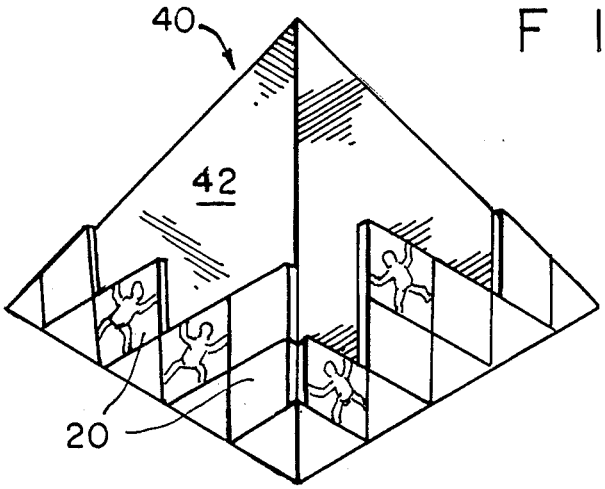
FIG. 3
FIG. 4
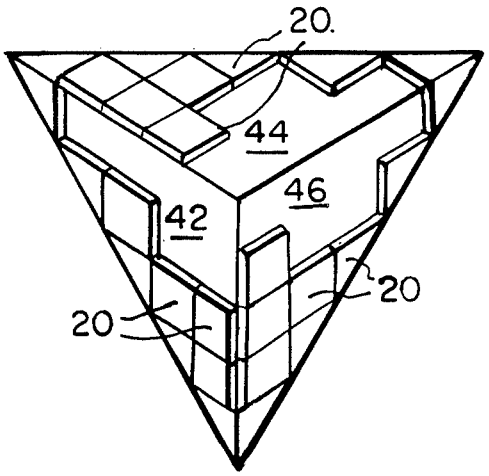
FIG. 6
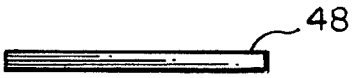
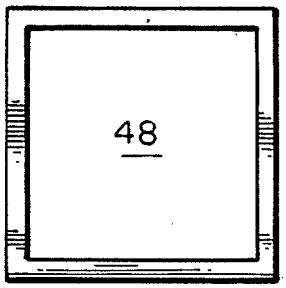
FIG. 7
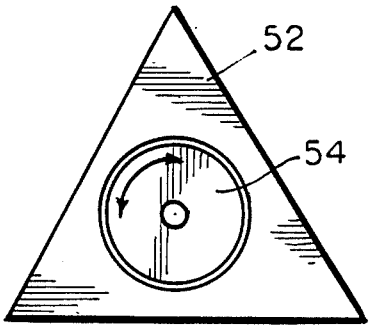
FIG. 5

GAME WITH STACKING PIECES ON INCLINED SURFACES

The present invention relates to a game intended to be played by two, three or more people in which pieces are stacked on an inclined surface.

Among all the thousands and millions of living species on this planet, only humans can and do play games. Game playing is an integral part of human activity and intellectual growth. Some games are violent in nature and outcome, others afford almost purely intellectual stimulation. Some games require complex equipment, others can be played with the simplest of devices. The present invention is concerned with a unique but simple game which can be played and enjoyed by people having a wide range of intellectual ability and experience in the game and yet provide stimulation and satisfaction to all players.

There are a wide variety of games in which small pieces are placed and manipulated upon a larger extending surface. Among the most popular species are checkers in which typically circular pieces are manipulated on a flat board having squares of alternate colors, and chess in which pieces having different capabilities are manipulated in a much more complex pattern on a similar board. Many games have also been devised in which players place elements, markers or pieces (the terms are used herein interchangeably) alternately onto some surface to attempt to form a contiguous sequence of three, four, five or more markers while at the same time blocking the opponent from doing the same. The complex Japanese game "Go" is one example of this type of game. Games have also been devised in which the markers are stacked vertically, usually in some form of supporting structure. The object here as well is to form a line or lines of three, four or five markers while blocking the opponent from doing the same.

For many of these games such as Chess and "Go" the rules are relatively complicated and take considerable time to learn. Moreover, the complexity of the rules precludes younger children and those of limited intellectual ability from participating at all in the game. Other games, such as the classic paper and pencil game "X & O" are simple enough for even younger children to learn but the full possibilities of such simple games can be understood very quickly by adults and those of superior intellectual abilities so that interest in the game quickly wanes among these people. For other games the markers and pieces are too complex for economical manufacture and use.

The present invention relates to a unique game of the type in which markers are positioned on a surface in order to try to form contiguous lines of similar markers while at the same blocking an opponent or opponents from doing the same. The rules of the game can be learned by anyone within a few seconds and the game can be enjoyed by young children as well as those of limited intellectual ability. At the same time the strategical possibilities of the game are virtually endless and those of superior intellectual capabilities and those who have studied and practiced the game for many years can still enjoy its complexities and possibilities. The game has been called "Magic Mountain", "Fire and Ice", "King of the Hill", "Pyramid Power" and "3-4-5 Connect". In short, the unique game of the present invention combines the simplicity of a game such as "X & O" with the intellectual challenge of a game such as Chess or "Go".

Moreover, the game of the present invention provides physical and auditory stimulation as the pieces are stacked, and visual stimulation in that they form an attractive and interesting pattern which may be either two dimensional or three dimensional.

In the game of the present invention, a plurality of elements divided into first and second visually differentiable sets, for example of different colors, can be placed on an extending surface which is arranged to be inclined with respect to the surface on which it is placed. Preferably, the extending surface has a color different from and contrasting with the color of the elements. A plurality of raised portions are provided on the extending surface along the lower edge. Because the surface is inclined, elements placed on the surface will be supported first by the raised portions and then by elements supported on the raised portion so that all of the elements are directly or indirectly supported by the raised portions.

The raised portions preferably make a saw-toothed pattern with raised edges defining notches ending in a 90° angle for each receiving a square element or marker having a dimension on each side equal to the length of the raised edges. The extending surface may be a planar surface and be mounted on a support or the like so that the extending surface forms an obtuse angle with the surface on which it rests.

In a second embodiment of the invention, a plurality of similar surfaces forms a three or more sided pyramid with the saw-toothed shaped raised portions extending around the pyramid base adjacent the lower edges of each of the extending triangular surfaces defining the pyramid. The pyramid configuration not only provides an interesting visual effect as the markers or elements are placed on the various surfaces of the pyramid but enhances the interest of play since markers on an upwardly extending edge of one side of the pyramid can match abutting markers on the same edge of an adjacent side of the pyramid. While the pyramid can be observed from above, the pyramid is preferably to be mounted on a platform so as to be rotatable by the players as they choose where to place their respective pieces.

The planar or pyramidal surface may be divided into polygonal sectors corresponding to the sectors that would be covered by the pieces Some or all of the sectors may be encoded with one or more figures or symbols. The markers in turn can be provided with an open or transparent center so that a symbol or figure can be seen through the open center of a stacked marker. In this way the symbol or figure can be "captured" as part of the game.

The centers may be wholly or partially open and may allow for placement of further objects or markers thereon.

BRIEF DESCRIPTION OF THE FIGURES

FIG. 3 shows a perspective view of a second embodiment of the present invention in which the pieces can be placed upon inclined surfaces forming a three sided pyramid.

FIG. 4 shows a top view of the embodiment of FIG. 3 showing the three sided pyramid.

FIG. 5 shows a bottom view of the pyramid of FIG. 3.

FIG. 6 shows a side view of a element having an open or transparent center and suitable for stacking on a pyramid.

FIG. 7 shows a top view of the element of FIG. 6.

DETAILED DESCRIPTION OF THE DRAWINGS

Figure 1:
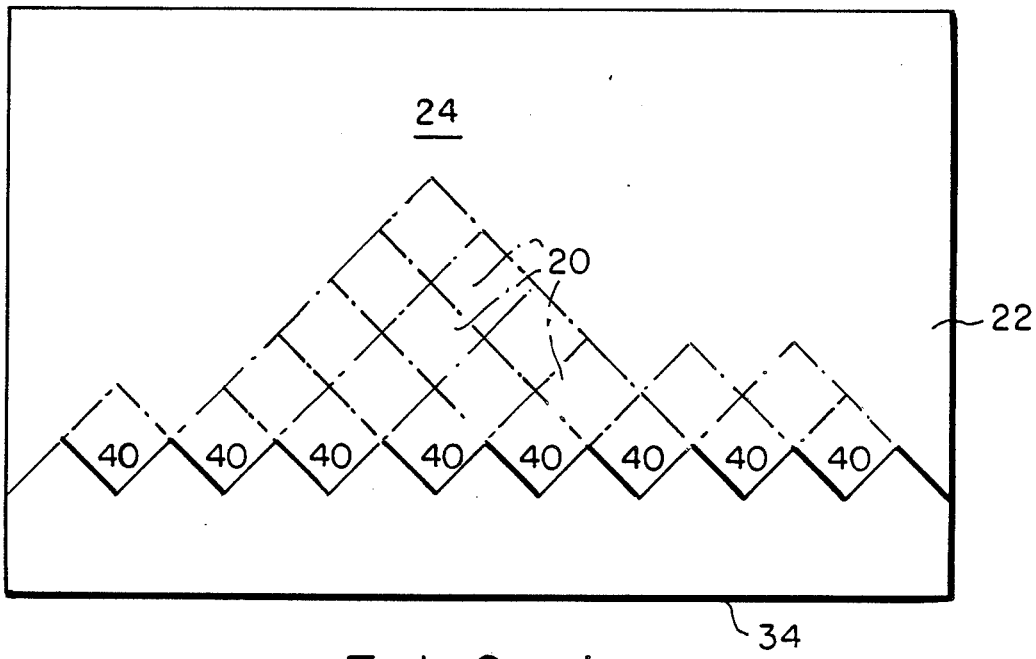
FIG. 1 shows a front view of one embodiment of the invention in which square pieces are placed upon a planar surface of a board.
Figure 2:
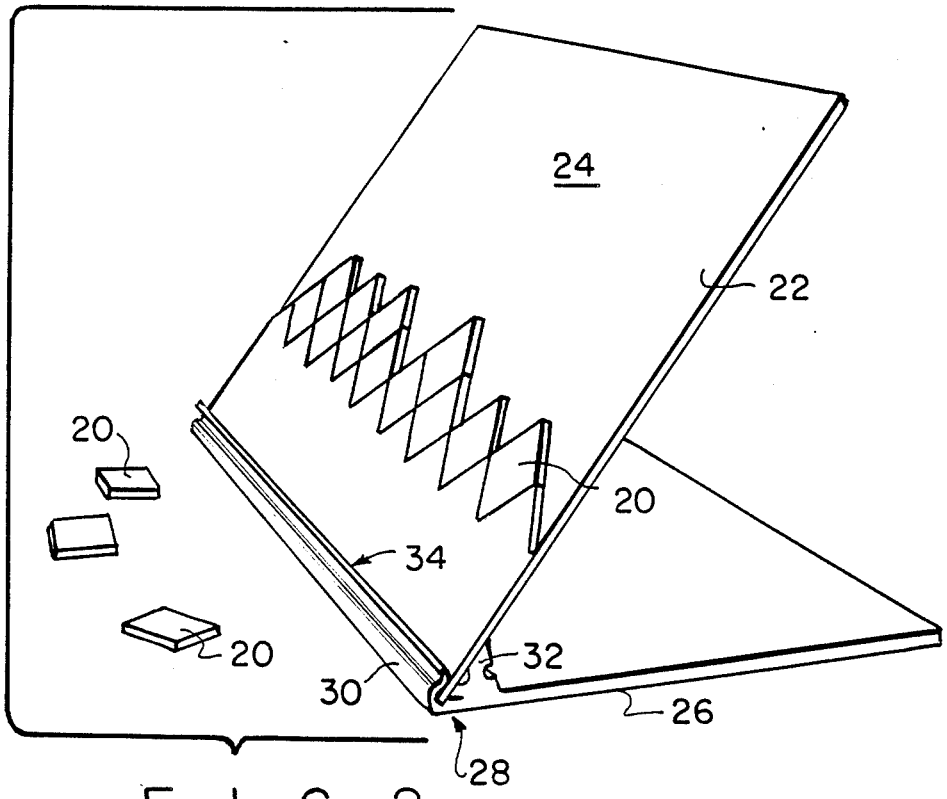
FIG. 2 shows a perspective view of the board of FIG. 1 supported on a surface at obtuse angle.

Reference now is made to FIG. 1 and FIG. 2 which illustrate a first embodiment of the invention in which a plurality of square pieces (20) can be placed upon a board (22) having a planar inclined extending surface (24). Board (22) is mounted at an obtuse angle with respect to the surface on which it is supported by support member (26). Board (22) and support member (26) may be made of any suitable material, and acrylic plastic, either transparent or opaque, provides a visually satisfactory extending surface (24). Support member (26) may be simply made of plastic with a groove (28) therein formed between rails (30) and (32) for holding board (22) at a desired angle. Rails (30) and (32) extend parallel to the lower edge (34) of board (22). Support members such as member (26) are common for supporting photographs or the like and can be made of any suitable material such as molded plastic or cardboard or wood. Alternately, board (22) and member (26) may be formed as a unitary structure. The obtuse angle at which the board extends is not critical, but an angle between 105 and 135 degrees has been found to be satisfactory. An angle of 135° is the angle of a pyramid formed of right triangle surfaces.

Upon board (22) adjacent the lower edge (28) a plurality of raised portions extend in a saw-toothed pattern. In the embodiment of FIGS. 1 and 2, the saw-toothed pattern provides eight downwardly extending triangular notches (40) each of which can receive any of the markers designated as (20). Each notch is a right triangle with its imaginary base parallel to the lower edge and sides extending downwardly from the base to form a ninety degree angle. The raised portions may be molded as part of plastic board (22) or may be separately formed and attached to the board in any suitable fashion.

In order to play the game, one player places one of his markers of a first color, for example red, onto the surface of board (22) with the surface of the marker conforming to the surface of the board and being held in a position with one of the corners pointing upward as can be seen in FIGS. 1 and 2 and supported by the adjacent edges of the notch. The height of the raised portions is preferably substantially equal to the thickness of the pieces so that a smooth surface is formed by the raised portions and pieces as can be best seen in FIG. 2. The player can put his marker or piece in any of the desired notches. The second player than places his marker of another color, for example white, in another notch. Play continues alternatively with the players placing the markers in the notches and on top of previously placed markers as can be seen in FIG. 1. Eight markers can be placed in the first row, seven in the second row etc. to form a right triangle - like shape. Thus, a total of thirty-six markers can be stacked. Other number of notches can be provided in each row.

The game is won when any one of the players forms a contiguous sequence of four of his markers or five of his markers or more as the players may decide before the game begins. Each time a marker is placed the support configuration is redefined. The rules may require the winning player's marker to form a straight line or any unbroken sequence may be permitted. Play can take place with two, three, four or more players as the players may wish. Additional players can add to the complexity and interest of the game.

FIGS. 3 and 4 illustrate a second three dimensional embodiment of FIG. 1. Raised saw-toothed portions are provided along the lower edges of each of the three sides of the three sided pyramid designated as (40). Sides (42), (44) and (46) are preferably identical and may be made again of any suitable material such as acrylic plastic or the like. Play proceeds exactly in the same way as in the first embodiment except that the pieces or elements (48) can be placed on any of the three inclined surfaces forming the pyramid. Contiguous pieces at the three edges of the pyramid can form part of the sequence so that a player may win with one or more of his markers on one side of the pyramid and the others on an adjacent side. Ten markers can be stacked on each side so the total number stackable on three sides is 30. Of course the pyramid can be dimensioned to accommodate any desired number of playing pieces. Many of the patterns formed during play will resemble the famous "snake" which is formed on a side of the great pyramid of Chichen Itza in the highlands of the Yucatan Peninsula at each Equinox.

The pieces may have illustrations or patterns on the surfaces to create more visual interest. For example, in FIGS. 3 and 4 depictions of climbing figures are provided.

The pieces (48) may be identical to those of FIGS. 1 and 2 or they may be formed as a frame (48) having an open center as shown in FIGS. 6 and 7. Markers (48) are preferably used with a pyramid having its sides divided into sectors corresponding to where the stacked frames will lie. Such sectors are provided with illustrations or symbols which can be seen through the open center of a marker. In this way the symbol or figure can be "captured". The markers shown in FIGS. 6 and 7 have square interior openings, but the opening may be of any shape and may allow for placement of further objects thereon.

FIG. 5 shows a bottom view of the present invention in which a rotating platform fixed to the base (52) of the three sided pyramid is provided. Rotating platform (54) can likewise be made of any suitable material such as a plastic and fixed by any suitable means to the base of the three sided triangle. The platform operates like a lazy susan to enable either player to rotate the platform about an axis running between the base (52) and the pyramid tip in order to suitably position any side on which the player wishes to place a marker. Platform (54) may also be removable or other structure provided in base (52) through which the pieces can be inserted for storage within the pyramid. Alternately, the base may be open and the pyramid supported solely by the lower edges of sides (42), (44), and (46).

Three dimensional configurations are not limited to those shown in FIGS. 3–5. The pyramid in fact may have any multiple of three sides, such as six sides, nine sides, etc. Moreover, by utilizing curved surfaces and curved elements pyramid like structures of four sides or other sides can be employed. The elements stacked on such curved surfaces course will not normally be planar squares.

For any pyramid the sum of the angles at the top must be less than 360°. The less the sum the steeper the pyramid. Of course for pyramids having a number of surfaces not three or a multiple thereof, the pieces must be rhombuses.

In the preferred embodiment the markers of each player have the same color on both sides. However, the markers can be made with one player's color on one side and the other player's colors on the other side. With these types of markers a game like "Othello" can be played in which markers can be captured and "flipped". In such arrangement the pieces may be magnetized so flipping can occur without destroying the stack. The board (22) or sides (42), (44) and (46) may be unornamented or provided with some interesting picture or pattern.

Raised areas may also be provided on the sides (42), (44) and (46) above the raised portions adjacent the lower edges. Such raised portions are "neutral" to both players and "break up" sequences being formed by both players, making play more interesting.

It may also be desirable to be able to have all of the stacked pieces fall together at the end of the game to provide visual and auditory stimulation or perhaps relief of frustration. Another possible modification is to bevel the edges of the markers. Beveling the piece edges at an angle of 45° as shown causes abutting pieces from adjacent sides to form a sharp edge, but beveling is not necessary to a satisfactory game.

The planar surfaces of the pyramid may also be provided with recessed portions which will allow placement therein or removal therefrom of some further object.

Pressure or light sensitive switches may be provided below or on the surfaces of the pyramid to trigger audible sounds, backlighting of some portion of the surface, or some other effect.

Many changes and modifications in the above described embodiments of the invention can of course be carried out without departing from the scope thereof. Accordingly, that scope is intended to be limited only by the scope of the appended claims.

What is claimed is:

1. A game comprising:

means for defining a planar extending surface having a lower edge and a plurality of triangular shaped raised portions extending in a saw-tooth pattern along said lower edge, said portions forming a sequence of triangular notches each being a right triangle with a base parallel to said lower edge, and sides extending from either side of said base, the intersection between said sides forming a right angle opposite said base;

means adapted for resting on another surface for mounting said surface defining means so that said extending surface is inclined away from said another surface to form an obtuse angle with respect to said another surface; and a plurality of pieces having a square shape with four edges each substantially equal to the length of a side of said triangular notch, each piece having a surface conforming to the inclined extending surface, each of said pieces being adapted to be placed on said inclined surface with two adjacent edges thereof contacting and being supported by the sides of said raised triangular shaped portions or by the edges of other pieces, said plurality of pieces being divided into visually differentiable first and second sets so that two or more players can place said pieces in patterns on said inclined surface to play a game.

2. A game as in claim 1 where said pieces of said first set are of a first color and the pieces of said second set are of a second color different from said first color.

3. A game as in claim 2 wherein said extending surface is of a third color different from said first and second colors.

4. A game as in claim 1 wherein said surface defining means and said pieces are formed of plastic.

5. A game as in claim 1 wherein said surface defining means and said pieces are formed of cardboard.

6. A game as in claim 1 wherein said surface defining means is formed of opaque plastic.

7. A game as in claim 1 wherein at least some of said pieces are provided with an open interior structure so that a portion of the underlying surface can be seen therethrough.

8. A game comprising a pyramid with three planar extending surfaces each having a lower edge and a plurality of triangular shaped raised portions extending in a saw-tooth pattern along said lower edge, said portions forming a sequence of triangular notches, each notch being a right triangle with a base parallel to said lower edge, and sides extending from either side of said base, the intersection between said sides forming a right angle opposite said base; and a plurality of pieces having a square shape with four edges each substantially equal to the length of a side of said triangular notch, each piece having a surface conforming to the inclined extending surface, each of said pieces being adapted to be placed on one of said extending surfaces with two adjacent edges thereof contacting and being supported by the sides of said raised triangular shaped portions or by the edges of other pieces, said plurality of pieces being divided into visually differentiable first and second sets so that two or more players can place said pieces in patterns on said extending surface to play a game.

9. A game as in claim 8 wherein at least some of said pieces are provided with an open interior structure so that a portion of the underlying structure can be seen therethrough.

10. A game as in claim 8 where said pieces of said first set are of a first color and said pieces of said second set are of a second color different from said first color.

11. A game as in claim 10 wherein said pyramid surfaces are of a third color different from said first and second colors.

12. A game as in claim 8 wherein said extending surfaces and said pieces are formed of plastic.

13. A game as in claim 8 wherein said extending surfaces and said pieces are formed of cardboard.

14. A game as in claim 8 wherein said extending surfaces are formed of opaque plastic.

15. A game as in claim 8 wherein said pyramid is provided with a base and including a platform mounted on said base so that said platform may be placed on another surface and said pyramid rotated with respect to said platform.

* * * * *